US009475076B2

(12) United States Patent
Fernholz et al.

(10) Patent No.: US 9,475,076 B2
(45) Date of Patent: Oct. 25, 2016

(54) SYSTEM FOR TREATING SURFACES OF OBJECTS HAVING A TREATMENT SPACE SELECTIONALLY DELIMITED BY A CONVEYING ELEMENT

(75) Inventors: Juergen Fernholz, Herrenberg (DE); Ralph Meier, Waldenbuch (DE); Joerg Robbin, Pfaeffingen (DE)

(73) Assignee: EISENMANN AG, Boeblingen (DE)

( * ) Notice: Subject to any disclaimer, the term of this patent is extended or adjusted under 35 U.S.C. 154(b) by 353 days.

(21) Appl. No.: 13/518,098

(22) PCT Filed: Nov. 24, 2010

(86) PCT No.: PCT/EP2010/007119

§ 371 (c)(1),
(2), (4) Date: Aug. 14, 2012

(87) PCT Pub. No.: WO2011/085746

PCT Pub. Date: Jul. 21, 2011

(65) Prior Publication Data

US 2012/0304924 A1 Dec. 6, 2012

(30) Foreign Application Priority Data

Dec. 22, 2009 (DE) ..... 10 2009 060 649

(51) Int. Cl.

| | |
|---|---|
| ***B05C 13/02*** | (2006.01) |
| ***B05B 13/02*** | (2006.01) |
| ***B05C 13/00*** | (2006.01) |

(Continued)

(52) U.S. Cl.

CPC ..... *B05B 13/0221* (2013.01); *B05B 13/0242* (2013.01); *B05B 13/0285* (2013.01); *B05B 13/0447* (2013.01); *B05B 15/1214* (2013.01); *B05C 13/00* (2013.01); *B05B 13/0431* (2013.01); *B05C 15/00* (2013.01)

(58) Field of Classification Search

CPC .... B05B 15/1296; B05B 15/04; Y10S 55/46
USPC ..... 118/326, 501, 503, DIG. 7; 427/478; 901/43; 239/695, 265.25; 55/DIG. 46; 454/50; 198/341.08

See application file for complete search history.

(56) References Cited

U.S. PATENT DOCUMENTS 3,913,523 A * 10/1975 Probst et al. ..... 118/626
3,915,117 A * 10/1975 Schertler ..... C23C 14/566 118/719

(Continued)

FOREIGN PATENT DOCUMENTS

| | | |
|---|---|---|
| DE | 2 415 092 A1 | 10/1974 |
| GB | 2 411 853 A | 9/2005 |
| WO | 00/41817 A1 | 7/2000 |

*Primary Examiner* — Karl Kurple

(74) *Attorney, Agent, or Firm* — Factor Intellectual Property Law Group, Ltd.

(57) ABSTRACT

A system for treating surfaces of objects, in particular for painting objects, in particular vehicle body parts, comprising a treatment booth, which defines a treatment space. The objects are conveyed into and back out of the treatment space by means of a conveying device. The conveying device comprises a conveying element, by means of which a first surface having a first retaining device for at least one object and at least one second surface having a second retaining device for at least one object are provided. The first and the second surface are arranged in such a way that the first or the second surface bounds the treatment space at least in some areas depending on the position of the conveying element.

5 Claims, 4 Drawing Sheets

(51) Int. Cl.

| | |
|---|---|
| ***B05B 13/04*** | (2006.01) |
| ***B05B 15/12*** | (2006.01) |
| *B05C 15/00* | (2006.01) |

(56) References Cited

U.S. PATENT DOCUMENTS

| | | | | | |
|---|---|---|---|---|---|
| 4,704,298 | A * | 11/1987 | Herman | B05B 7/226 | 118/302 |
| 4,821,673 | A * | 4/1989 | Kirigakubo et al. | 118/319 | |
| 5,164,011 | A * | 11/1992 | Ray | B05B 13/0285 | 118/500 |
| 5,183,547 | A * | 2/1993 | Ikeda | C23C 14/56 | 118/730 |
| 5,288,324 | A * | 2/1994 | Shaneyfelt | 118/326 | |
| 5,529,815 | A * | 6/1996 | Lemelson | 427/575 | |
| 5,551,980 | A * | 9/1996 | Turnbo | B05B 13/0285 | 118/500 |
| 5,690,995 | A * | 11/1997 | Fischli et al. | 427/180 | |
| 5,698,039 | A * | 12/1997 | Patz | B01J 19/123 | 134/1.1 |
| 5,769,949 | A * | 6/1998 | Cienkus et al. | 118/621 | |
| 5,780,205 | A * | 7/1998 | Beckers et al. | 430/320 | |
| 6,007,875 | A * | 12/1999 | Grunwald et al. | 427/489 | |
| 6,340,501 | B1 * | 1/2002 | Kamiyama et al. | 427/255.6 | |
| 6,406,544 | B1 * | 6/2002 | Stewart | 118/719 | |
| 6,554,980 | B1 * | 4/2003 | Patz et al. | 204/298.25 | |
| 6,576,093 | B1 * | 6/2003 | Burroughes et al. | 204/192.1 | |
| 6,743,295 | B2 * | 6/2004 | Keller et al. | 118/309 | |
| 6,946,032 | B2 * | 9/2005 | Pohl et al. | 118/308 | |
| 7,014,670 | B2 * | 3/2006 | Shutic et al. | 55/315 | |
| 7,051,670 | B2 * | 5/2006 | Santandrea et al. | 118/50.1 | |
| 7,325,750 | B2 * | 2/2008 | Shutic et al. | 239/1 | |
| 7,399,362 | B2 * | 7/2008 | Pohl et al. | 118/313 | |
| 8,176,869 | B2 * | 5/2012 | Linares | 118/66 | |
| 8,419,000 | B2 * | 4/2013 | St. John | B25B 11/00 | 118/500 |
| 8,770,143 | B2 * | 7/2014 | Endo et al. | 118/723 R | |
| 2002/0037368 | A1 * | 3/2002 | Rick et al. | 427/314 | |
| 2002/0134311 | A1 * | 9/2002 | Yoshino et al. | 118/719 | |
| 2007/0243075 | A1 | 10/2007 | Hirose | | |
| 2009/0283031 | A1 * | 11/2009 | Grasso | 118/104 | |
| 2010/0282283 | A1 * | 11/2010 | Bauer | B05B 13/0285 | 135/96 |
| 2012/0064728 | A1 * | 3/2012 | Yi et al. | 438/758 | |
| 2012/0097098 | A1 * | 4/2012 | Pei | 118/313 | |
| 2012/0145075 | A1 * | 6/2012 | Takahashi | B25J 19/0079 | 118/323 |
| 2013/0026676 | A1 * | 1/2013 | Tresse | B05B 15/1214 | 264/241 |

* cited by examiner

SYSTEM FOR TREATING SURFACES OF OBJECTS HAVING A TREATMENT SPACE SELECTIONALLY DELIMITED BY A CONVEYING ELEMENT

RELATED APPLICATIONS

This application claims the filing benefit of International Patent Application No. PCT/EP2010/007119, filed Nov. 24, 2010, which claims the filing benefit of German Patent Application No. 10 2009 060 649.1 filed Dec. 22, 2009, the contents of both of which are incorporated herein by reference.

TECHNICAL FIELD AND BACKGROUND OF THE INVENTION

The invention relates to a system for treating, in particular painting, surfaces of objects, in particular of vehicle body parts, having a) a treatment enclosure which defines a treatment space;

b) a conveying device by means of which the objects can be conveyed into the treatment space and out of the treatment space again.

Systems of this type which are used for painting vehicle bodies and in particular vehicle body parts are known on the market. In those systems, the treatment space is frequently in the form of a painting tunnel through which the vehicle body parts to be painted are conveyed continuously.

To that end, components of the conveying device, which in such cases is comparatively complex, such as, for example, components of an overhead trolley conveyor, of a roller conveyor or the like, are located in the treatment space inside the treatment enclosure. Even in treatment enclosures that are not in the form of continuous tunnels, corresponding conveyor components are arranged inside the treatment enclosure.

However, the components of the conveying device used that are arranged inside the treatment enclosure are constantly exposed to the atmosphere prevailing in the treatment space. In the case of painting systems, this includes inter alia paint that has not been applied to the objects, which experts refer to as "overspray". The overspray is taken up by a stream of air fed to the painting enclosure and is fed to a separating system so that the air, optionally after suitable conditioning, can be passed back into the coating enclosure again.

The overspray, which like the applied paint generally contains both solids and/or binders as well as solvents, can settle on the mentioned components of the conveying device, which as a result are subjected to considerable stress. Moving parts of the conveying device in particular are highly susceptible to sticking as a result of overspray particles.

SUMMARY OF THE INVENTION

Accordingly, it is an object of the invention to provide a system of the type mentioned at the beginning which makes allowances for the above considerations.

The object may be achieved in a system of the type mentioned at the beginning as follows:

c) the conveying device comprises a conveying element by means of which there are provided a first surface having a first retaining device for at least one object, and at least a second surface having a second retaining device for at least one object, wherein d) the first and second surfaces are so arranged that, depending on the position of the conveying element, the first or second surface delimits at least a region of the treatment space.

According to the invention, a type of exchangeable inner surface or exchangeable inner surface region of the treatment enclosure is provided by these measures. The retaining devices and the corresponding surfaces are then largely the only components of the conveying device which are regularly exposed to the atmosphere in the treatment space. However, these can be designed without moving parts so that overspray particles which settle on the corresponding surface and the associated retaining device do not have a disruptive effect on the conveying device.

It is advantageous if the conveying element is a revolving element which can be revolved about an axis of revolution.

It has been found to be particularly advantageous if the revolving element is a revolving wall associated with the treatment space and having a first wall surface and a second wall surface opposite thereto. In this case, the first wall surface carries the first retaining device and the second wall surface then correspondingly carries the second retaining device.

If the axis of revolution runs vertically, the forces that occur during the revolution can be handled particularly well.

It is advantageous if there is provided a device by means of which a separating fluid can be fed to the first surface and/or to the second surface of the conveying element in order to take up overspray that occurs in the painting space. Overspray that has occurred can thus successfully be eliminated from the treatment space. In addition, the amount of overspray which settles on the surfaces and on the retaining devices can thus be reduced, so that the interval between two necessary maintenance operations or inspections can be lengthened.

When the conveying element is so configured that it does not seal off the treatment space in a gas-tight manner when it is in a position in which the first or second surface delimits at least a region of the treatment space, the region on the surface of the conveying element that is remote from the treatment space can be used as a flash-off zone for freshly painted objects. Suction devices for the painting enclosure, which are present as standard, also act upon that region, so that paint constituents evaporating from the objects are drawn past the conveying element and into the treatment space.

It is advantageous if there are additionally provided transport means by which objects can be conveyed to the retaining device on the surface of the conveying element that is not delimiting a region of the painting space or can be removed from that retaining device. In this manner, the number of cycles of the system can be kept correspondingly high.

It is advantageous if the transport means comprise a transfer robot for objects, which transfer robot is preferably arranged to be stationary.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

An exemplary embodiment of the invention is explained in greater detail hereinbelow by means of the drawings, in which.

DETAILED DESCRIPTION OF THE PRESENT INVENTION

Figure 1:
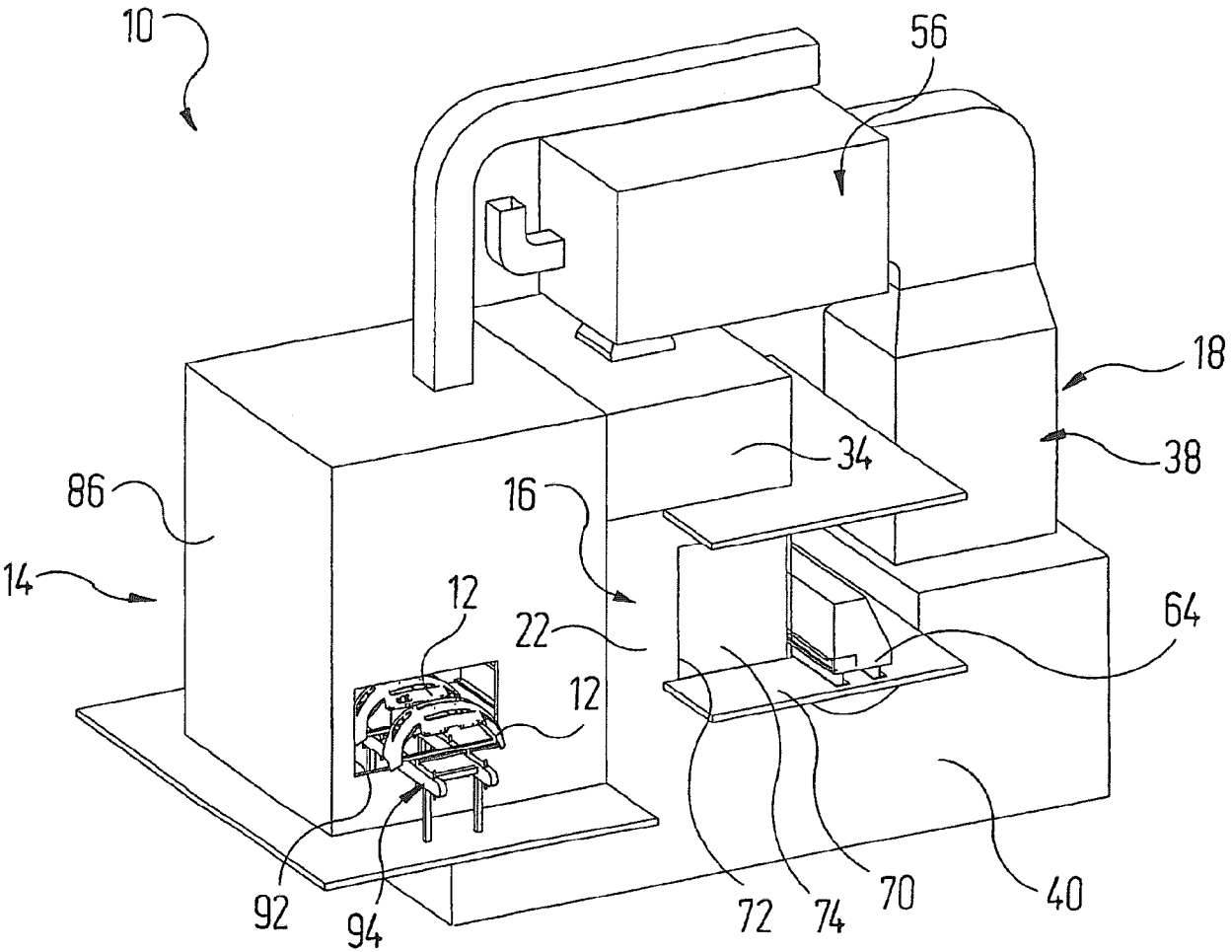
FIG. 1 shows a perspective view of a painting system having a painting enclosure and a loading and removal zone.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

In FIGS. 1 to 4, 10 denotes generally a system for painting objects 12, which in the present exemplary embodiment are shown by way of example as bumpers of a motor vehicle. These have been cleaned and degreased, for example, in pretreatment stations (not shown specifically) arranged upstream of the painting system 10.

The painting system 10 comprises a loading and removal zone 14, a painting enclosure 16 arranged next to it, and a cleaning zone 18 which communicates with the painting enclosure 16 and in which overspray particles carried with the enclosure air are separated from the enclosure air.

The painting enclosure 16 defines a painting space 20, which is delimited on three sides by vertical side walls 22, 24 and a vertical enclosure wall 26 running perpendicular to and between the side walls 22, 24. Opposite the enclosure wall 26 there is arranged a revolving wall 28 which serves as the conveying element and is mounted for revolution about a vertical axis of revolution 30. Associated with the revolving wall 28 are a first and a second working position, which will be discussed in greater detail hereinbelow. In its working positions, it delimits the painting space 20 on the side of the painting enclosure 16 opposite the enclosure wall 26 and separates the painting space 20 spatially from the loading and removal zone 14. In the present exemplary embodiment, the revolving wall 28 runs parallel to the enclosure wall 26 in each of its working positions.

In a modification (not shown specifically), the axis of revolution of the revolving wall 28 can also run at any desired angle relative to the vertical and in particular horizontally.

Where reference is made hereinbelow to the revolving wall 28 in order to explain the painting system 10, it is intended as being in one of its working positions, unless stated otherwise.

The painting enclosure 16 has at the top a horizontal enclosure cover 32, which is configured in the conventional manner as the lower boundary of an air supply chamber 34 with a filter cover.

The painting space 20 is open at the bottom to a flow channel 36, via which the painting space 20 is in communication with a separating region 38 of the cleaning zone 18.

The flow channel 36 is delimited on both sides of the painting system 10 by vertical channel side walls 40, of which only one channel wall 40 is visible in FIG. 1. The channel walls 40 each extend in the same plane as the vertical side walls 22 and 24 of the painting enclosure 16.

The flow channel 36 is delimited at the bottom by an air-guiding base 42 which extends from the bottom edge 44 of the revolving wall 28 in the direction pointing away from the loading and removal zone 14 to a vertical channel wall 46. The air-guiding base 42 comprises a first base section 48, which runs with a slight downward incline from the bottom edge 44 of the revolving wall 28 to a collecting trough 50, which in turn extends between the channel side walls 40 perpendicular thereto. A second base section 52 of the air-guiding base 42 extends with a slight upward incline from the collecting trough 50 to the vertical channel wall 46.

Opposite the air-guiding base 42, the flow channel 36 is delimited by a curved upper air-guiding wall 54 which is semi-circular in cross-section, the summit of the curve being arranged approximately centrally above the collecting trough 50.

As mentioned above, the flow channel 36 opens into a separating region 38 of the cleaning zone 18. In the separating region 38, overspray particles carried with the enclosure air are separated, for example, by means of an electrostatically operating separating device. The separation operation is of no further interest here and more detailed explanations thereof will therefore not be given.

Air coming from the air supply chamber 34 flows downwards through the painting space 20 to the flow channel 36 and thereby takes up overspray. The flow channel 36 guides the enclosure air, which is then loaded with overspray particles, to the cleaning zone 18 in such a manner that it flows through the separating region 38 from bottom to top. The enclosure air freed of overspray particles then passes into a conditioning region 56 of the cleaning zone 18, which is arranged above the separating region 38 and in which it is brought to the correct temperature and humidity again in a manner known per se. From there, the cleaned enclosure air is guided to the air supply chamber 34 above the painting enclosure 16 again, where it can optionally be mixed with unused fresh air.

In the painting space 20 there is arranged a seven-axis application robot 58, as is known per se. The application robot 58 is carried by a carriage 60, which on the outer side 62 of the enclosure wall 26 remote from the painting space 20 can be displaced in the horizontal direction along the enclosure wall 26 in a carriage housing 64. The enclosure wall 26 has a horizontal guide slot 66. A connecting member 68, which couples the application robot 58 to the carriage 60, extends through the guide slot 66. The guide slot 66 is sealed with respect to the carriage housing 64 on both sides of the enclosure wall 26 by, for example, lamellar seals (not shown specifically).

The carriage housing 64 extends beyond the vertical side wall 22 of the painting enclosure 16 and leads to a maintenance platform 70. The side wall 22 has a gate opening 72, which can be closed by a gate 74, for example a flap gate or a sliding gate. The gate opening 72 is sufficiently large to allow the application robot 58 to be moved through it to the maintenance platform 70 by correspondingly displacing the carriage 60 in the carriage housing 64.

The revolving wall 28 has on its first wall surface 76 and on its opposite wall surface 78 a first retainer 80 and a second retainer 82, respectively, as the first and second retaining devices for the bumpers 12. In a modification (not shown specifically here), each wall surface 76, 78 of the revolving wall 28 carries a plurality of first retainers 80 or a plurality of second retainers 82, which are preferably arranged above one another and accordingly form the first and second retaining devices, respectively.

Beneath the revolving wall 28 there is arranged a drive unit 84 by means of which the revolving wall 28 can be revolved about its axis of revolution 30. Accordingly, either the wall surface 76 having the first retainer 80 or the wall surface 78 having the second retainer 82 can face the painting space 20 with the application robot 58, while the other wall surface 78 or 76 having its associated retainer 82 or 80 faces the loading and removal zone 14. These two orientations of the wall surfaces 76, 78 having the two retainers 80 and 82 define the first and second working positions of the revolving wall 28 mentioned above. In the first working position of the revolving wall 28, its first wall surface 76 accordingly delimits a region of the painting space 20; in the second working position of the revolving wall 28, its second wall surface 78 delimits a region of the painting space 20.

In a modification (likewise not shown here), the revolving wall can also have more than the two wall surfaces 76, 78. If the revolving wall is in the form of, for example, a triangle which is equilateral in horizontal section, three wall surfaces are possible, which in turn can carry one or more retainers for the bumpers 12. The revolving wall can optionally also provide more than three wall surfaces having corresponding retainers.

In general terms, the surfaces carrying the retainers for the bumpers 12 are arranged offset relative to one another in the direction of revolution so that, depending on the position of the revolving wall, each of those surfaces can delimit at least a region of the painting space 20. In the present exemplary embodiment, the wall surfaces 76 and 78 are correspondingly arranged offset relative to one another by 180° in the direction of revolution.

The loading and removal zone 14 comprises a housing 86 which delimits a transfer space 88 in which there is arranged a stationary transfer robot 90 by means of which the bumpers 12 can be handled and transferred. In one of its working positions, the revolving wall 28 delimits the transfer space 88 in the direction towards the painting space 20 but does not seal the two spaces 88 and 20 from one another in a gas-tight manner.

The housing 86 has a loading opening 92 through which there runs a supply conveyor 94 on which bumpers 12 which are to be painted can be conveyed into the transfer space 88 to the robot 90. The bumpers 12 are placed onto the supply conveyor 94 outside the housing 86 by means of a conveyor system (not shown specifically here).

The housing 86 further has a delivery opening 96, through which there runs a delivery conveyor 98 on which painted bumpers 12 can be conveyed out of the transfer space 88 again. The painted bumpers 12 are removed from the delivery conveyor 98 outside the housing 86 by means of a conveyor system (likewise not shown specifically here) and conveyed to their further destination.

The transfer robot 90 is of such a size and is so arranged in the transfer space 88 that it is able to reach the supply conveyor 94 and the delivery conveyor 98 as well as the retainer 80 or 82 facing it in dependence on the working position of the revolving wall 28 and can accordingly receive or deliver bumpers 12.

The cover 100 of the transfer space 88 corresponds to the enclosure end cover 32 and is permeable to air. It leads to a second air supply chamber 102, via which fresh air is supplied to the transfer space 88. This will be discussed further hereinbelow.

A separating fluid flows in a largely cohesive layer over the inner surfaces of the side walls 22, 24 and of the enclosure wall 26 of the painting enclosure 16 and the wall surfaces 76 and 78 of the revolving wall 28. The separating fluid takes up some of the overspray carried with the enclosure air as the enclosure air from the painting enclosure 16 flows downwards to the flow channel 36.

Figure 2:
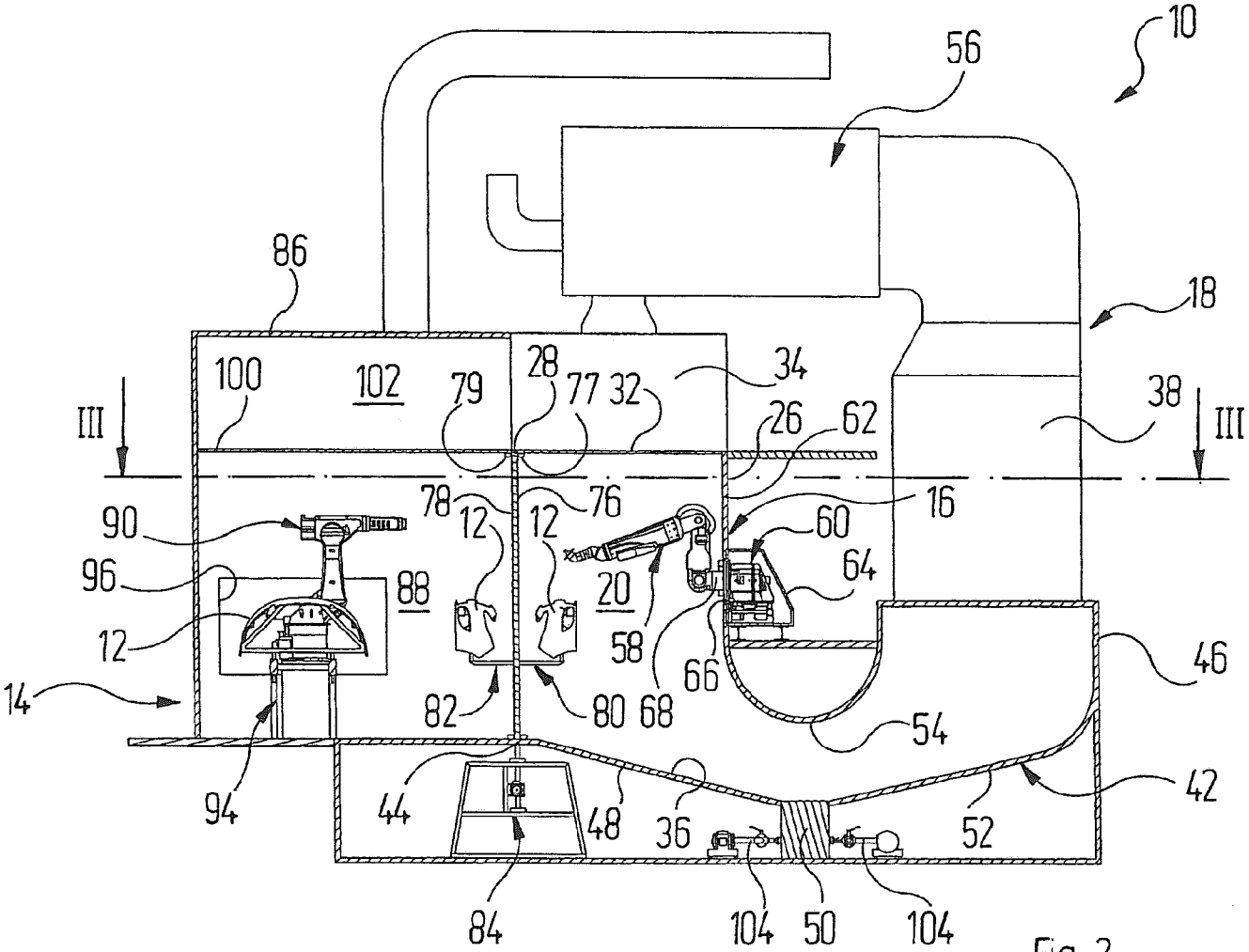
FIG. 2 shows a vertical section of the painting system of FIG. 1 along cutting line II-II in FIG. 3.
Figure 3:
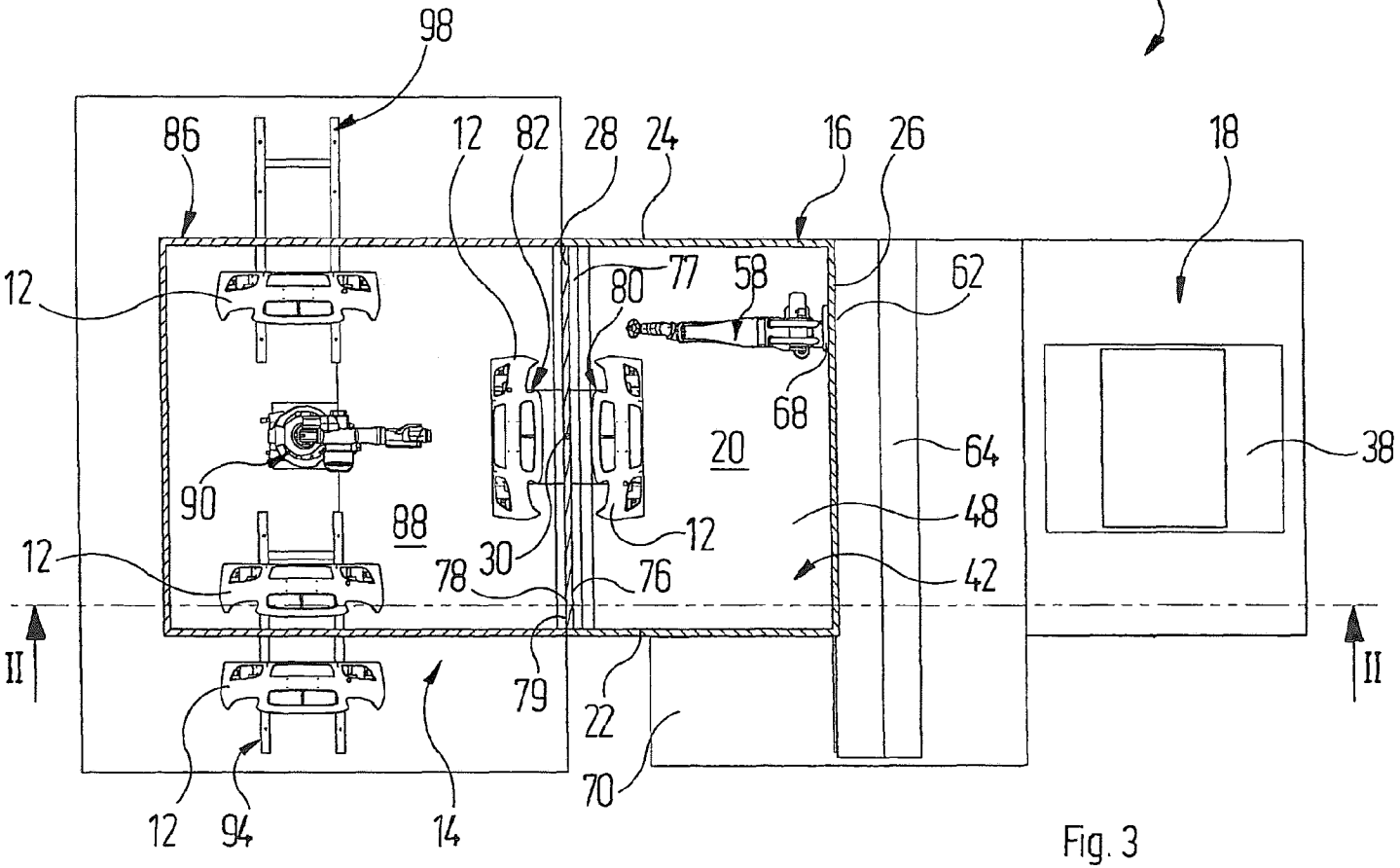
FIG. 3 shows a horizontal section of the painting system of FIG. 1 along cutting line III-III in FIG. 2, a revolving enclosure wall between the painting enclosure and the loading and removal zone being shown in a first working position.
Figure 4:
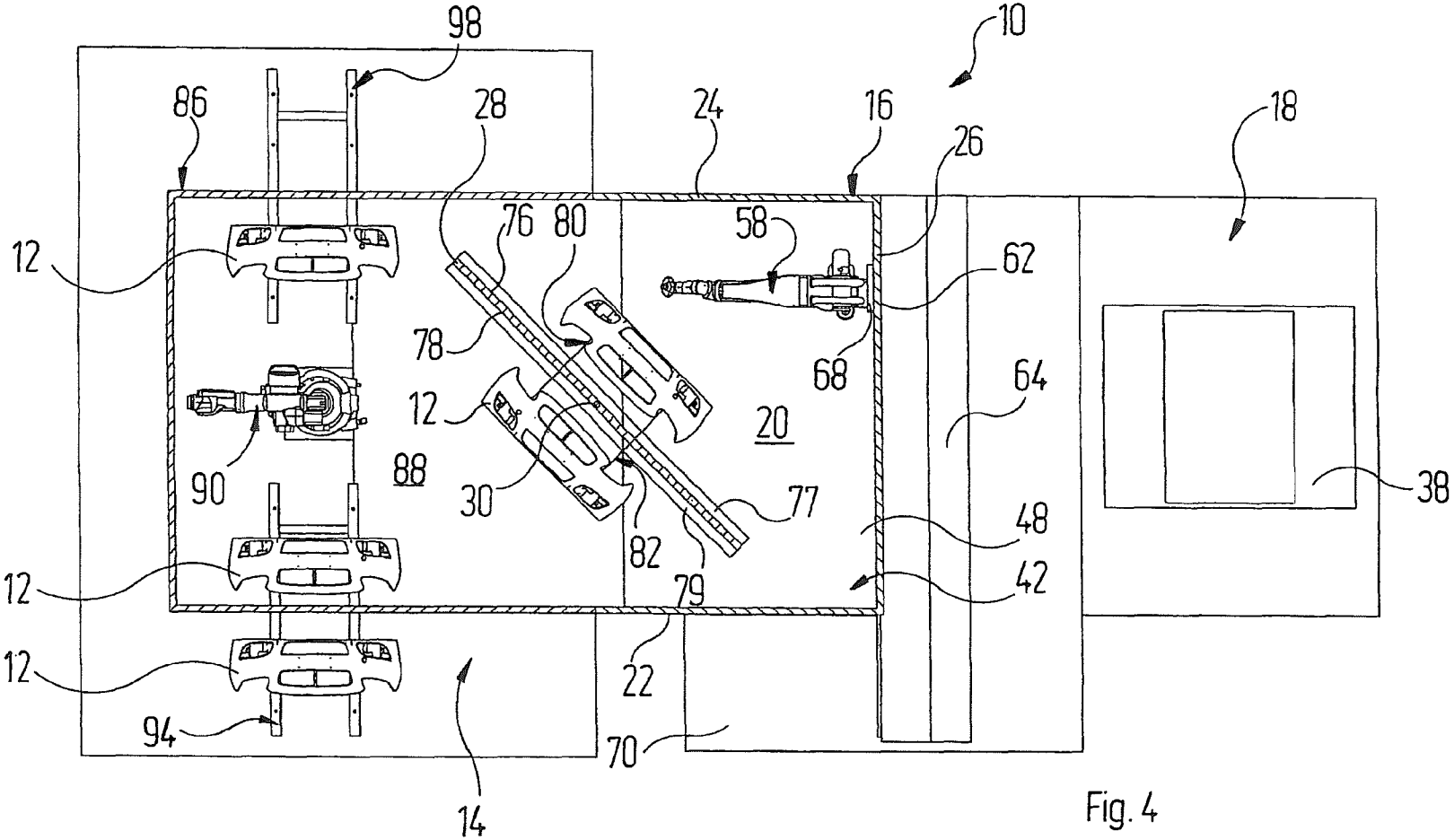
FIG. 4 shows a section corresponding to FIG. 3, the revolving enclosure wall being shown in a revolved position relative to its working position.

As can be seen in FIGS. 2 to 4, the wall surfaces 76 and the wall surfaces 78 each carry a horizontal distributor trough 77 and 79 at the top edge of the revolving wall 28. Separating fluid can be fed to each distributor trough when the corresponding distributor trough 77 or 79 is arranged in the painting space 20. Accordingly, separating fluid flows constantly over the wall surface 76 or 78 facing the painting space 20.

The separating fluid loaded with overspray there flows via the first base section 48 of the air-guiding base 42 into the collecting trough 50. From there, the separating fluid can be fed by means of two pumps 104 to a cleaning and preparation process, in which it is freed of the paint overspray in a manner known per se. The separating fluid can then be fed back to the corresponding wall surfaces in a loop.

The mode of operation of the painting system 10 described above will now be explained hereinbelow:

As the starting situation, it is assumed that both retainers 80, 82 on the revolving wall 28 are empty and the revolving wall 28 is in its second working position in which the second wall surface 78 having the second retainer 82 is facing the painting space 20 and the first wall surface 76 having the first retainer 80 is facing the transfer space 88 and the transfer robot 90.

Throughout the operation, the bumpers 12 rest on goods carriers (not shown here) which can be grasped and/or handled by the transfer robot 90 and other conveying components.

The supply conveyor 94 is loaded with bumpers 12 that are to be painted from outside the housing 86. The bumpers 12 are then conveyed through the loading opening 92 into the transfer space 88 to the transfer robot 90. The transfer robot 90 removes the bumper 12 closest to it from the supply conveyor 94 and places it on the initially empty first retainer 80 on the revolving wall 28. The supply conveyor 94 is controlled further in such a manner that the next bumper 12 on the supply conveyor 94 reaches the transfer robot 90.

The revolving wall 28 is revolved through 180° by means of the drive unit 84 and brought into its first working position, in which its wall surface 76 having the first retainer 80 faces the painting space 20. This first working position of the revolving wall 28 is shown in FIGS. 2 and 3. Both the application robot 58 in the painting space 20 and the transfer robot 90 in the transfer space 88 are brought into a safety position beforehand so that the revolving wall 28 is not able to touch either of the robots 58 and 90 during its movement.

The bumper 12 on the first retainer 80 is then painted, for which purpose the application robot 58 is controlled accordingly.

During the painting operation, the transfer robot 90 takes the next bumper 12 from the supply conveyor 94 and positions it on the second retainer 82 on the wall surface 78 of the revolving wall 28.

The overspray that occurs during painting is taken up, as described above, by the enclosure air flowing through the painting space 20 and by the separating fluid flowing downwards over the inner surfaces of the painting enclosure 16 and is collected and separated in the further procedure.

When the bumper 12 on the first retainer 80 has been painted completely, the robots 58 and 90 are brought into their safety positions again and the revolving wall 28 is again revolved through 180° about its axis of revolution 30 by means of the drive unit 84 so that it assumes its second working position. In FIG. 4, the revolving wall 28 is shown in a position between the first and second working positions during the revolving operation.

The bumper 12 on the first retainer 80 that has just been painted is then located in the transfer space 88, whereas the second retainer 82 of the revolving wall 28 carries the corresponding as yet unpainted bumper 12 in the painting space 20.

The bumper 12 on the second retainer 82 is then painted there. During this operation, the transfer robot 90 removes the already painted bumper 12 from the first retainer 80 and places it on the delivery conveyor 98. This conveys the painted bumper 12 out of the transfer space 88 through the delivery opening 96 in the housing 86

Then—still during the painting operation—the transfer robot 90 takes the next bumper 12 from the supply conveyor 94 and positions it on the first retainer 80 on the wall surface 76 of the revolving wall 28.

When painting is complete, the revolving wall 28 is revolved into its first working position again and the entire operation is repeated again with painting of the as yet unpainted bumper 12, transfer of the painted bumper 12 to the delivery conveyor 98 and transfer of an unpainted bumper 12 from the supply conveyor 94.

The revolving wall 28 does not have to be revolved in the same direction of revolution each time so that it has completed a 360° circle after two revolutions. Instead, the revolving wall 28 can be swivelled once through 180° in one direction and then back again through 180° in the opposite direction. The terms revolve and swivel are accordingly to be understood as being functionally equivalent in this context.

The transfer space 88 at the same time serves as a flash-off zone for the painted bumpers 12. For that reason, on the one hand fresh air is fed to the transfer space 88 from the second air supply chamber 102 via the airpermeable cover 100 and on the other hand the transfer space 88 and the painting space 20 are not separated from one another in a gas-tight manner by the revolving wall 28 in its working positions. The enclosure air flowing along the revolving wall 28 in the painting enclosure 16 generates a suction effect which is sufficient to draw into the painting space 20 air in the region of the freshly painted bumpers 12 in the transfer space 88, which air is loaded with evaporation products from the freshly painted bumpers 12. This flash-off air is there dissipated by the enclosure air.

In the construction of the painting system 10 discussed above, the painting space 20 does not contain any moving parts of a conveying system for transporting the bumpers 12 that are to be painted or the freshly painted bumpers 12. If the application robot 58 requires maintenance, it can simply be moved out of the painting space 20 through the gate opening 72 thereof so that it is easily accessible to maintenance staff from outside the painting enclosure 16 via the maintenance platform 70.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A system for treating surfaces of objects, the system comprising:

a) a treatment enclosure which defines a treatment space and objects are moved into and removed from the treatment space via a single entry;

b) a conveying device comprising a conveying element, the conveying element receiving the objects in a transfer space and then conveying the objects to the treatment space by rotating 180 degrees, wherein c) the conveying element has a first surface carrying a first retaining device for carrying at least one object, and at least a second surface carrying a second retaining device for at carrying least one object, the treatment enclosure includes a single painting space which is located in the treatment space, the single painting space being located opposite of the transfer space and the conveying element is located in the single entry in between the transfer space and the treatment space; and wherein d) the first and second surfaces are arranged opposite each other and are configured to be positioned such that when one surface directly faces and delimits at least a region of the treatment space an other surface is facing an opposite direction towards the transfer space and delimits at least a region of the transfer space, and when the conveying element is rotated 180 degrees the regions delimited by the surfaces are reversed so that the one surface previously delimiting at least a region of the treatment space now delimits at least a region of the transfer space and the other surface previously delimiting at least a region of the transfer space now delimits at least a region of the treatment space.

2. The system according to claim 1, wherein a feeding device provides a separating fluid to the first surface and/or to the second surface of the conveying element in order to take up overspray that occurs in a painting space.

3. The system according to claim 1, wherein the conveying element does not seal off the treatment space in a gas-tight manner when the conveying element is in a position in which the first or second surface delimits at least a region of the treatment space.

4. The system according to claim 1, wherein a transport means conveys objects to the retaining device on the surface of the conveying element that is not delimiting a region of the treatment space or said transport means removes objects from the first or second retaining device.

5. The system according to claim 4, wherein the transport means is arranged to be stationary.

* * * * *